US005371490A

United States Patent [19]

Martinides

[11] Patent Number: 5,371,490

[45] Date of Patent: Dec. 6, 1994

[54] SYSTEM FOR ELECTRONIC SAFEGUARDING AGAINST BURGLARY USING MULTIPLE TRANSMITTERS AND RECEIVERS

[75] Inventor: Markus Martinides, Schaffhausen, Switzerland

[73] Assignee: Actron Entwicklungs AG, Rotkreuz, Switzerland

[21] Appl. No.: 894,709

[22] Filed: Jun. 5, 1992

Related U.S. Application Data

[63] Continuation-in-part of Ser. No. 482,699, Feb. 21, 1990, abandoned.

[30] Foreign Application Priority Data

Mar. 22, 1989 [CH] Switzerland ..... 1078/89

[51] Int. Cl.[5] ..... G08B 13/14

[52] U.S. Cl. ..... 340/572; 342/27

[58] Field of Search ..... 340/572, 522; 342/27

[56] References Cited

U.S. PATENT DOCUMENTS 4,531,117 7/1985 Nourse et al. ..... 340/572

4,667,185 5/1987 Nourse et al. ..... 340/572

*Primary Examiner*—Jeffery A. Hofsass

*Attorney, Agent, or Firm*—Nies, Kurz, Bergert & Tamburro

[57] ABSTRACT

A system for electronic safeguarding against burglary, or for monitoring, having a signal emitter and a receiver for receiving signals from a resonance label if the label is located in the zone of emitted signals. The system is adapted for use in stores, such as department stores, to detect unauthorized removal of items that carry a resonance label. The receiver evaluates the received signals to trigger an alarm signal upon detection by a receiver of a signal from a resonance label. Plural emitter-signal pairs are provided in which the respective emitter signals are wobbled at staggered frequencies within a broad frequency band. The emitter is also operative to emit and inoperative not to emit periodically only during alternating time phases and the receiver evaluates signals received by it for triggering the alarm only during the intervals between the signal emitting state of the emitter.

12 Claims, 5 Drawing Sheets

SYSTEM FOR ELECTRONIC SAFEGUARDING AGAINST BURGLARY USING MULTIPLE TRANSMITTERS AND RECEIVERS

This application is a continuation-in-part of copending application Ser. No. 07/482,699, filed Feb. 21, 1990, now abandoned.

BACKGROUND OF THE INVENTION

1. FIELD OF THE INVENTION

The present invention relates to an electronic safety system, and specifically to a system for electronic safeguarding against burglary intended for use in stores, specifically in department stores, including a plurality of emitters and a plurality of receivers each defining respective emitter-receiver pairs intended to cooperate with a label equipped with a resonance circuit, the emitters each being operative to produce an electromagnetic field which excites the resonance circuit of the label if such label is located within the zone of the electromagnetic field from an associated emitter, the receivers each being operative to respond to electromagnetic signals from an associated emitter and electromagnetic signals from the label and to evaluate said signals and to trigger an alarm upon detection of a signal from the resonance label.

2. DESCRIPTION OF THE PRIOR ART

A multi-installation safeguarding system of this kind is disclosed e.g. in U.S. Pat. No. 4,667,185 (Nourse et al.). In the known system the different emitter-receiver pairs are synchronized with each other. The emitters are alternatively switched on to be operative and off to be inoperative. The receivers are only activated during quiescent intervals between emitted bursts. In U.S. Pat. 4,531,117 (Nourse et al.) a single installation system is disclosed in which the emitter is wobbled (swept) through a frequency range in which the resonant frequency of the resonance label is located. In the presence of a resonance label a characteristic deformation of the received signal is generated which is evaluated and leads to the triggering of the alarm. The receiver is designed narrow-banded and its frequency is always tuned to the emitter frequency.

In systems as mentioned above interfering signals from various sources superimpose themselves over the received signal from the label, and as the characteristic of the deformation caused by the label fluctuates within wide limits, it is very difficult to achieve a sufficient discrimination of the label signal (an intelligence signal) from the interference signals. The most significant interfering signals cannot be avoided in spite of filtering.

In the single installation system reflections and diffractions of the emitter signal itself occur which interfere with each other and with the original emitter signal. Because these interferences depend, due to the phase difference of superimposed signals, from the momentary emitter frequency, the receiver signal is also different for each frequency, particularly also in case of an absence of any label. Accordingly, a receiver signal is produced which differs distinctly from a constant (and only theoretically present) "rest signal" and looks confusingly like a label signal when the emitter is wobbled.

In addition to these interferences, similar interferences are produced in the multi-installation system by a superimposition of the signals of adjacent emitters (and their reflections).

In the single installation system the disturbing interferences can be eliminated by switching on and off the emitter during alternating time intervals and by indentifying the label only during the time intervals in which the emitter is inoperative (echo method). Alternatively, a background subtraction technique can be used for this purpose as well. In the multi-installation system this is, however, not sufficient even if the system is synchronized.

SUMMARY OF THE INVENTION

It is, therefore, a general object of the present invention to provide a means for an electronic safeguarding against burglary which is in a position to sufficiently eliminate the disturbing interfering influences in multi-installation systems without the need of an intrinsic and often little effective filtering.

This object is achieved according to the present invention by providing an apparatus for electronic safeguarding against burglary, the apparatus including a plurality of emitters and a plurality of receivers each defining respective emitter-receiver pairs intended to cooperate with a label equipped with a resonance circuit, the emitters each being operative to produce an electromagnetic field which excites the resonance circuit of the label if such label is located within the zone of the electromagnetic field from an associated emitter, the receivers each being operative to respond to electromagnetic signals from an associated emitter and electromagnetic signals from the label and to evaluate said signals and to trigger an alarm upon detection of a signal from the resonance label, said safeguarding apparatus including a plurality of emitters each operative to emit narrow banded signal frequencies that fall within a broader signal frequency band, a label with a resonance circuit having at least one resonant frequency within the broader signal frequency band, a plurality of receivers each operative to receive narrow banded frequencies corresponding with those of an associated emitter, wherein the narrow frequency band of each receiver is automatically tuned to and always corresponds with the narrow frequency band of the associated emitter of an emitter-receiver pair, and said receivers each including means for evaluating received signals for triggering an alarm signal upon detection by a receiver of a signal from a resonance label, means for individually wobbling over the broader frequency band the narrow frequency band of signals emitted by each emitter, the frequencies at which each emitter-receiver pair is wobbled being staggered relative to the frequencies of each other emitter-receiver pair so that each receiver can receive only signals from its paired emitter.

BRIEF DESCRIPTION OF THE DRAWINGS

The invention will be better understood when consideration is given to the following detailed description, particularly when considered in connection with the accompanying drawings wherein.

DETAILED DESCRIPTION OF THE PREFERRED EMBODIMENTS

Figure 1:
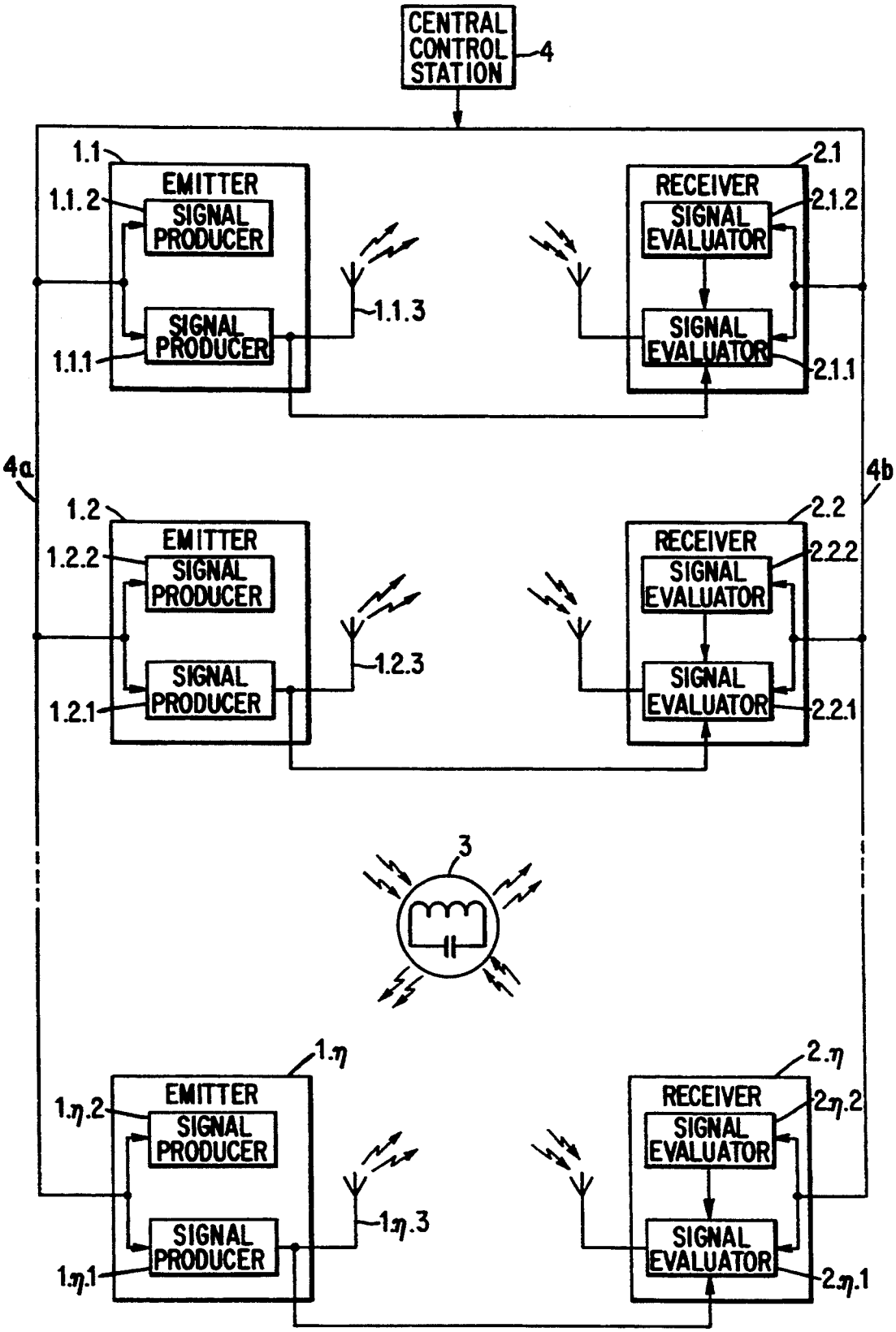
FIG. 1 shows an apparatus according to the present invention.

Referring now to the drawings and more specifically to FIG. 1, there is shown an apparatus including a plurality of n emitters 1.1–1.n and a respective number of receivers 2.1–2.n (multi-installation-system). The emitters and receivers are grouped in pairs. One such emitter-receiver pair is formed by emitter 1.1 and receiver 2.1 for example. Another emitter-receiver pair is formed by emitter 1.2 and receiver 2.2 and so on. Finally, also emitter 1.n and receiver 2.n form a respective emitter-receiver-pair.

Figure 2:
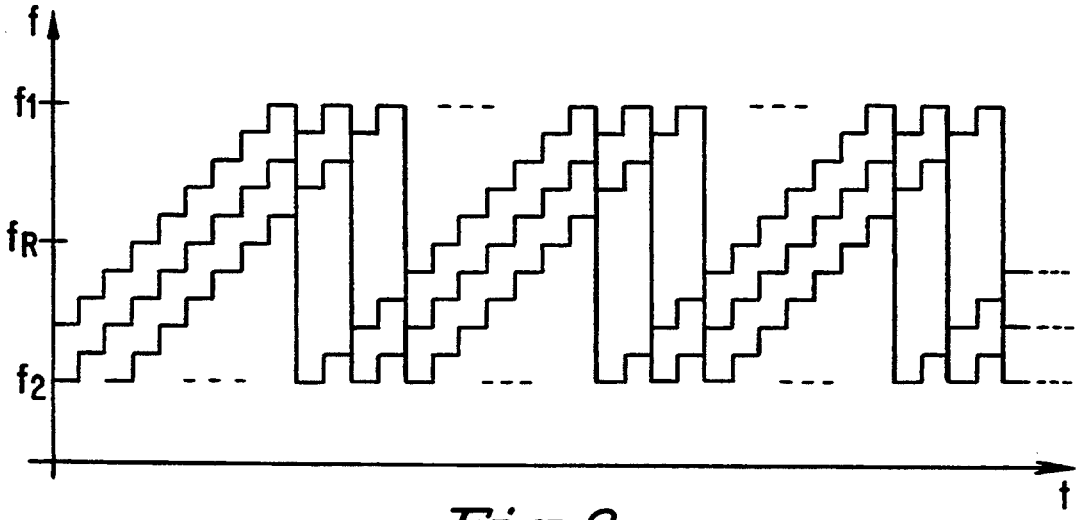
FIG. 2 shows in a time diagram the frequencies emitted by the emitters of the apparatus as shown in FIG. 1, whereby the frequencies are wobbled stepwise and in the form of a sawtooth wave.
Figure 3:
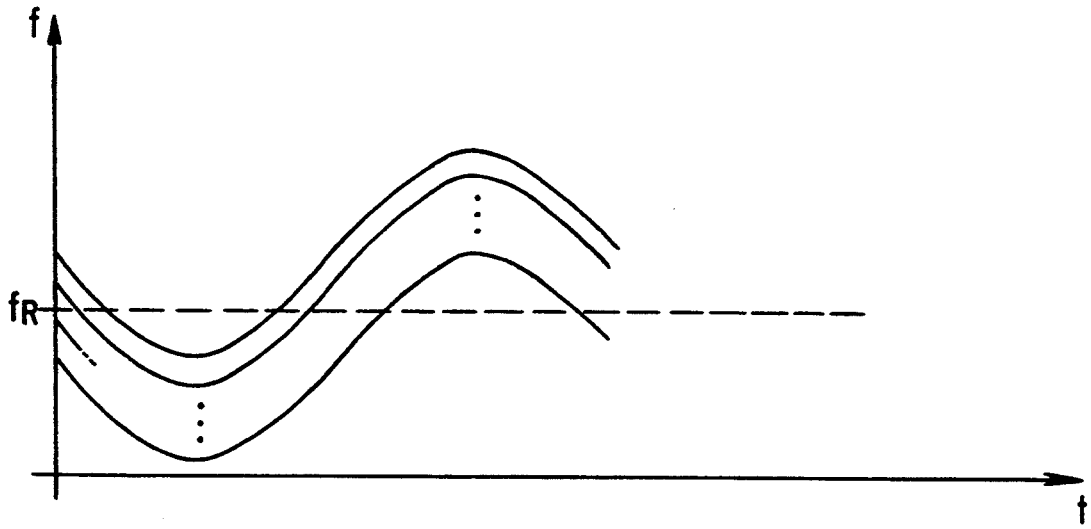
FIG. 3 shows in another time diagram the frequencies emitted by the emitters of the apparatus as shown in FIG. 1 whereby the frequencies are wobbled continuously and sinusoidally.

The emitter-receiver-pairs are operative to cooperate with a label 3 which is equipped with a resonance circuit having at least one resonance frequency $f_R$ (see FIGS. 2 and 3).

The emitters 1.1–1.n are each provided with means (being labeled 1.1.1–1.n.1) being operative to produce signals which have narrow-banded frequencies and which are emitted via antennas 1.1.3–1.n.3 thereby forming an electromagnetic field each which excites the resonance circuit of label 3 if such label is located within the zone of the electromagnetic field from at least one emitter.

The receivers 2.1–2.n are each provided with means (being labeled 2.1.1–2.n.1) being operative to respond to signals having narrow-banded frequencies from an associated emitter and to signals from label 3. Said means are further operative to evaluate said received signals and to trigger an alarm upon detection of a signal from the resonance label.

The emitters further include means 1.1.2–1.n.2 for individually wobbling over a given broader frequency band the narrow frequency band of the signals being emitted via antennas 1.1.3–1.n.3.

Said wobbling may be carried out step-wise and in the form of a sawtooth wave as this is shown in FIG. 2 or continuously and sinusoidally as this is shown in FIG. 3. The latter is preferred because less harmonics are produced. In both cases in addition the individual emitters are wobbled through with staggered frequencies. At any instant of time every emitter emits with a frequency which differs from the frequency of any other emitter. Because every receiver receives only at the respective frequency of its allocated emitter, no receiver feels an effect which originates from a different emitter than from the emitter allocated to it, i.e. every emitter-receiver installation functions also during the functioning of all other installations of the entire system such as if it were a single installation, i.e. such as if all other installations were switched off. If, accordingly, one emitter-receiver pair is optimally set for single operation, it remains optimal also during a simultaneous operation of all emitter-receiver pairs of the entire system.

In the multi-installation-system of FIG. 1 the individual emitter-receiver pairs are synchronized by signals which are sent to them via connections 4*a* and 4*b* from a central control station 4. Alternatively, such signals could also be sent wireless. The individual emitter-receiver pairs could also be synchronized by signals which they directly transmit to each other (e.g. via their emitters and receivers arranged for the recognition of the resonant labels). In the following, the already mentioned echo method and background subtraction technique are described for eliminating disturbing interferences which occur in each of the different single installation systems formed by the respective emitter-receiver pairs.

The echo method is characterized by switching on and off the emitter during alternating time intervals and by identifying the label only during the time intervals in which the emitter is inoperative. Use is thereby made of the fact that when switching the emitter on and off, respectively, the signals (electromagnetic field) emitted by the emitter and the interferences produced by same disappear at the one hand practically instantaneously, i.e. practically without any time delay, e.g. after ½ ξsec (within one period of oscillation) and that at the other hand the signal produced by the resonance label fades relatively slowly only, because the oscillating energy stored in the resonance label acting as an emitter alternates slowly only (up to 5 ξsec or 20–30 periods of oscillation respectively of the resonance frequency).

If, accordingly, each single installation system is operated such that the emitter emits periodically during a short time span an impulse having one single frequency and sufficient energy in order to excite the resonant label, it is possible for the receiver to identify in the following pause or interval the signal produced by the label, specifically based on the electromagnetic radiation which the label emits at its resonance frequency. This echo method is specifically effective because it is possible to set the receiver to a very high sensitivity during the interval due to the complete absence of the emitter signal (no "rest-signal")

In order to meet the resonance frequency of the resonance label the frequency of each emitted impulse is changed relative to the frequency of the preceding impulse by a small amount in accordance with known procedures. In this way the emitter is wobbled through step-wise as this is schematically shown in FIG. 2. In FIG. 2 the intermittent transmission and reception is, however, not shown for simplicity. The resonance frequency of the label is covered if the frequency steps are small enough and if the entirety of the thus defined "discrete" emitter frequencies fall within the resonance frequency range of the label.

Figure 4:
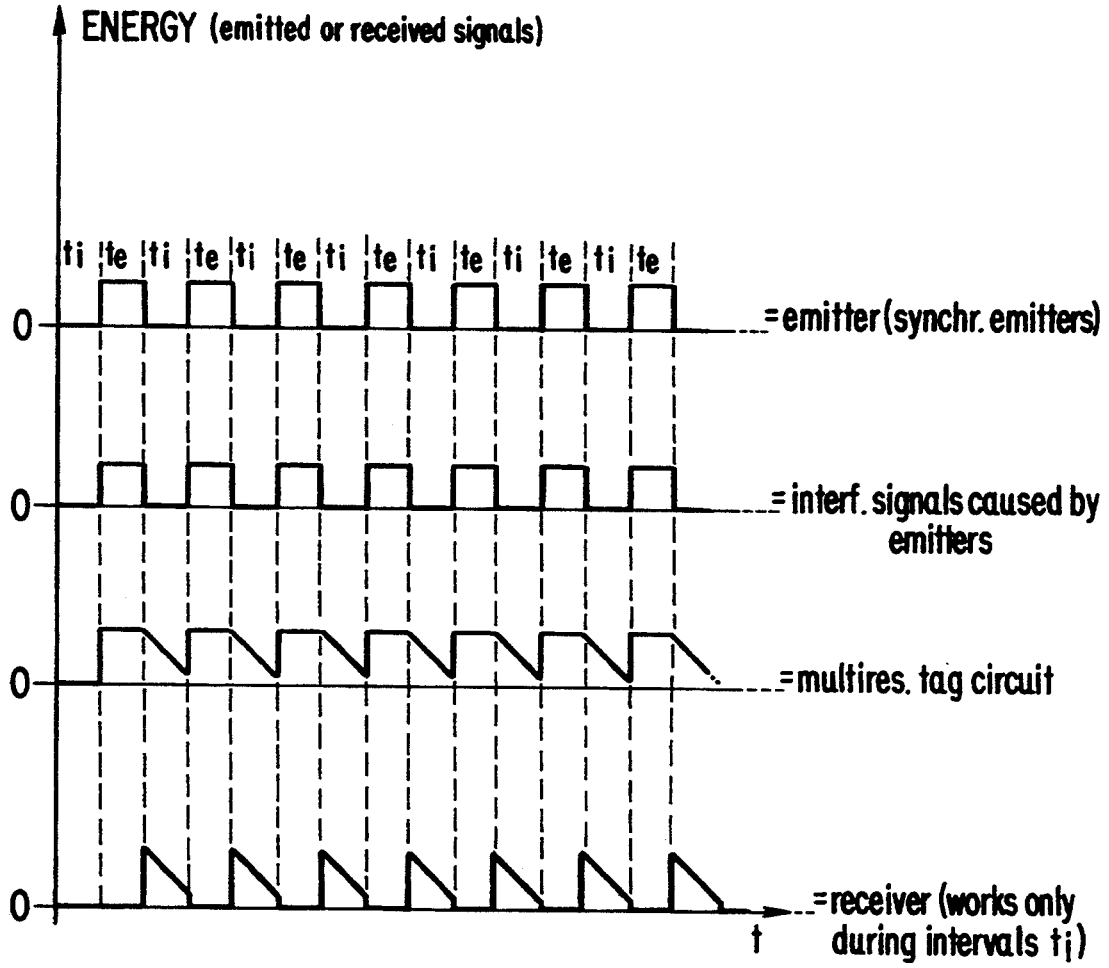
FIG. 4 illustrates purely schematically the principle of the so called echo method.

The foregoing explained principle of the echo method is also purely schematically illustrated in FIG. 4.

The emitter, or a plurality of synchronously working emitters, is sending out its signals only during intervals $t_e$ and is periodically interrupted during other time intervals $t_i$. Any interfering signals caused by the emitter(s) appear only during the intervals $t_e$ when the emitter is working. Both the signals of the emitter and the interference signals disappear practically without delay when the emitter is interrupted.

On the other hand, the signals of a multiresonant tag circuit possibly present within the zone of reception of the emitter signals will lose their energy only slowly during the intervals $t_i$ when the emitter signals (and the interference signals) are interrupted.

As the receiver is operative only during the intervals $t_i$, it will automatically only receive the desired signals from the multiresonant tag circuit and, if need be, trigger an alarm signal.

The background subtraction technique will now be explained with reference to FIGS. 5 and 6.

Figure 5:
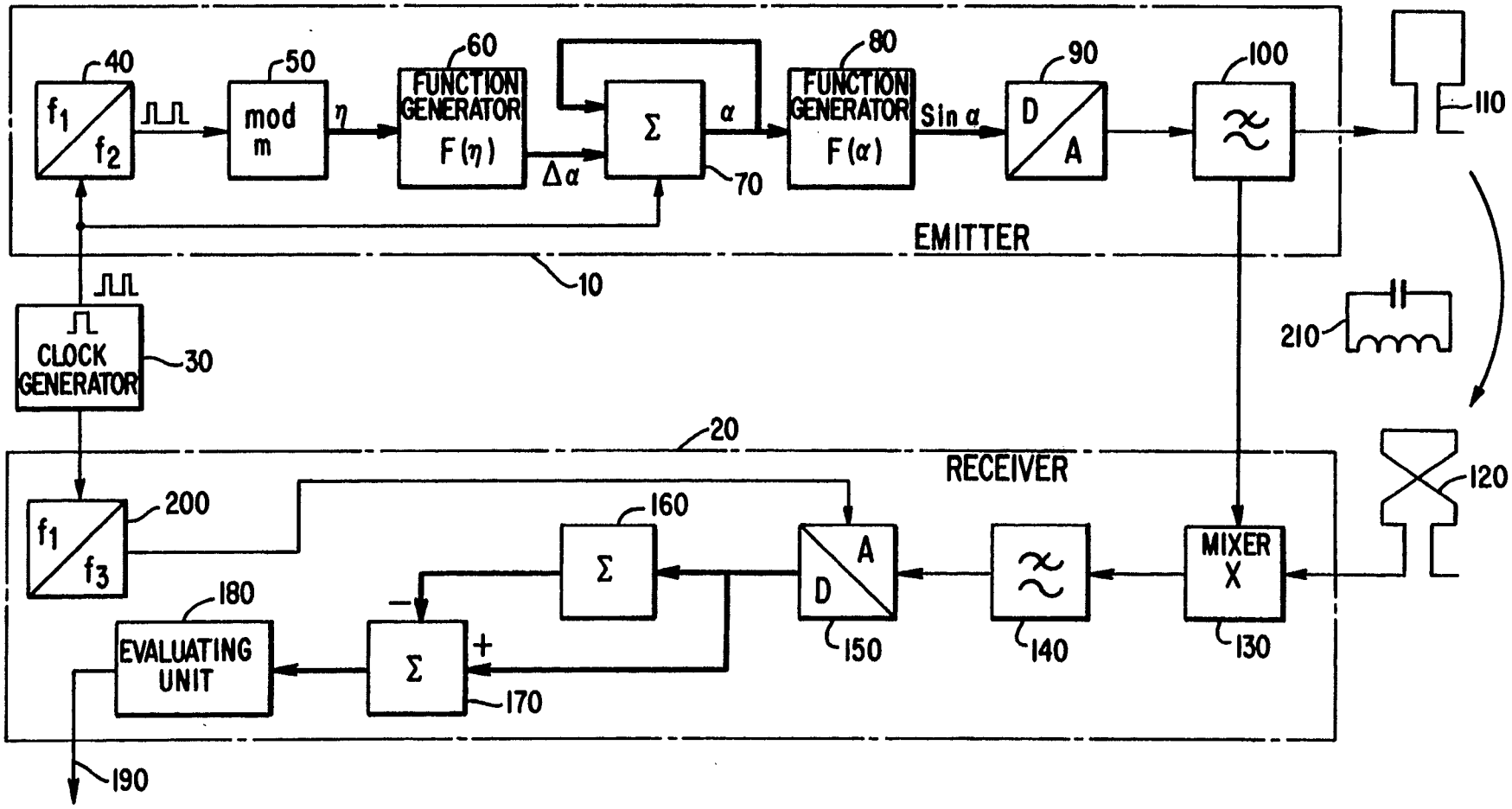
FIG. 5 shows an apparatus which is suitable for carrying out a background subtraction technique.

The apparatus of FIG. 5 which forms a single installation system which is suitable for carrying out the background subtraction technique comprises an emitter 10 and a receiver 20 which may be one of the emitters 1.1–1.n or receivers 2.1–2.n of FIG. 1, respectively. Both the emitter 10 and the receiver 20 are timed or clocked by a common clock generator 30. The clock generator 30 may be synchronized with other clock generators of other identical single installation systems. The clock generator generates a clock signal sequence with a clock frequency of approximately 48 MHz. The latter is consequently a multiple higher than the normally roughly 8.2 MHz resonant frequency of the resonant circuits on the labels to be detected or that of the signal sequence to be generated for this purpose by the transmitter 10.

In a frequency divider 40 the clock signal in the emitter 10 is divided (e.g. by a factor of 9) and is then supplied to a modulo-m counter 50. The latter supplies at its data output in the sequence of the divided clock signal the numbers from 0 to m as inputs for a series-connected function generator 60. The wobble cycles are determined through the cycle of the modulo-m counter 50 and its frequency is generally chosen between 80 and 85 Hz.

Figure 6A:
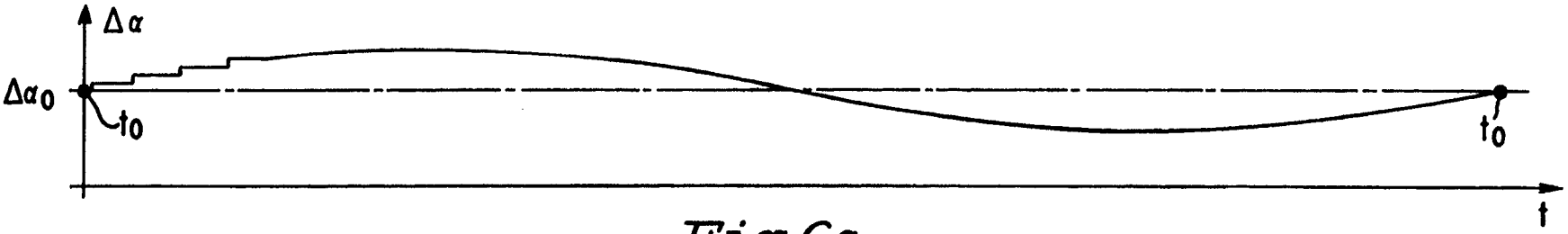
FIG. 6 (*a*), (*b*) and (*c*) show time diagrams for illustrating the function of the apparatus of FIG. 5.

The function generator 60 is preferably a PROM (with a storage capacity of e.g. 1 megabyte), in which is filed a function table. The filed function values correspond to the phase angle increment $\delta\alpha$ for the signal sequence to be generated digitally in the emitter 10. FIG. 6*a*) shows the phase angle increment as a function of time t. As a result of its discrete generation the time variation of the phase angle increment is stepped and the function value in each case changes with the rhythm of the divided clock signal. This is only shown to the left in FIG. 6*a*) at the start of the time scale, whereas in the case of longer times the stepped curve is made continuous in order to better show the function course. The latter is sinusoidal here about a phase angle increment value $\delta\alpha_o$ and not sawtooth-shaped. The advantage of the sinusoidal function course is fewer harmonics.

In an accumulator 70 the phase angle increment values supplied by the function generator 60 are accumulated in the rhythm of the clock signal by means of binary addition and from same are formed the values for the phase angle $\alpha$. The phase angle values $\alpha$ are supplied as inputs to a further function generator. As a result of the given bit number of the accumulator 70, its valve is automatically upwardly limited. The further function generator supplies for each phase angle value a fixed amplitude value of the signal sequence to be generated. The amplitude values of the signal sequence to be generated once again correspond to sine function values.

Figure 6B:
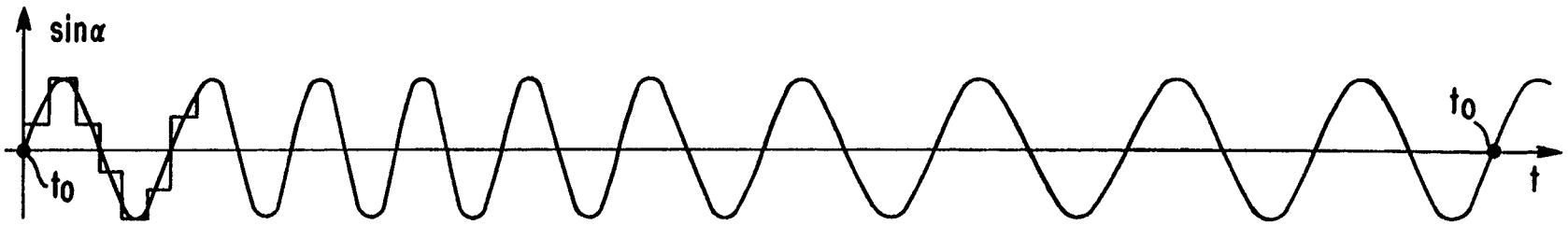
Figure 6C:
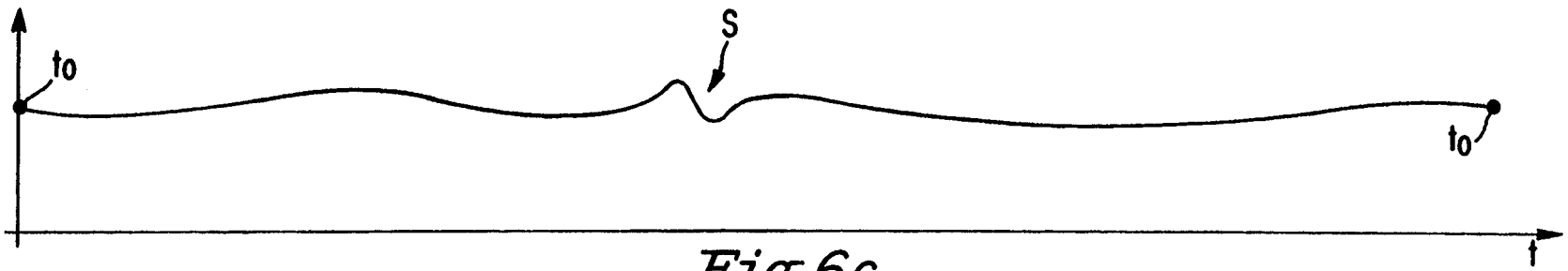

For converting the signal values supplied by the further function generator 80 into an analog voltage signal a digital-analog converter 90 is provided and its output signal is smoothed by means of the low-pass filter 100 before being supplied as an emitting signal to the emitting antenna 110. FIG. 6*b*), shows to the left at the start of the time scale, the discrete voltage values supplied by the digital-analog converter 90 and, extended over the entire time scale shown, the emitting signal curve obtained after filtering by means of the low-pass filter 100. FIG. 6*b*) clearly shows how the frequency of this curve increases or decreases over the wobble cycle shown in FIG. 6*a*) (normally by $\pm/-10\%$).

In the receiver 20 the signal sequence received by means of the receiving antenna is firstly demodulated. In that it is multiplied in the mixer 130 with the pure, i.e. interference-free emitting signal. For this purpose the emitting signal must not only be emitted from the emitter 10, but additionally directly transmitted via a line connection to the receiver 20. Demodulation in the mixer 130 using the pure, interference-free emitting signal in place of the otherwise conventional demodulation by multiplication of the interference-containing receiving signal with itself, makes a not inconsiderable contribution to reducing interference.

The result of the demodulation is a "d.c. voltage component", as well as a component with double the emitting signal frequency. The latter is eliminated in the series-connected low-pass filter 140 (limiting frequency at approximately 7 kHz). The remaining "d.c. voltage component" is shown diagrammatically in FIG. 6*c*). Roughly in the middle of the time scale it has a small "interference" designated S, as is typically caused by a resonant circuit 210 located between the emitting antenna 110 and the receiving antenna 120, but also as a result of diffractions and reflections of the emitting signal. For further evaluation and discrimination purposes the "d.c. voltage component" is scanned (e.g. 128×wobble cycle) and digitized. FIG. 5 only shows an analog-digital converter 150 for performing these functions, and for the synchronization of the scanning with the wobble cycles determined by the emitter 10 it is supplied with the clock signal of the clock generator 30, but appropriately divided in the frequency divider 200.

From the digitized signal values of the n (e.g. 800) wobble cycles in each case preceding the last wobble cycle a background is formed in the background former 160 and is subtracted in the difference former 170 from the digitized signal values of the last wobble cycle. However, preferably in each case m (e.g. 16) wobble cycles are combined into a "foreground" and from n' (e.g. 50) such "foregrounds" the background is formed. The background is then subtracted not only from the digitized signal values of the last wobble cycle, but also from the last formed "foreground".

Background formation and subtraction are used for differentiating interference S in the "d.c. voltage component", which in particular are caused by reflections, diffractions and superimposing of the emitting signal and which are substantially permanently present, from interference S caused by a resonant circuit.

To enable the dropout of the permanently present "interference" during background subtraction, there must be maximum coincidence of conditions in each wobble cycle, particularly with respect to the phase of the generated signal sequence. In each wobble cycle the sum over all the phase angle increments must be an integral multiple of $2\pi$. At the times designated $t_0$ in FIG. 2 there must be no phase jump. This very strict "phase condition" can be very simply fulfilled by digital emitting signal generation. To produce identical conditions in successive wobble cycles there is synchronization of the receiving signal scan using the clock signal also used for the timing of signal generation in the emitter.

It is obvious that there must be storage means for background formation in the background former 16 and which are able to cyclically store the digitized signal values determined by scanning. The signal values belonging to a wobble cycle in each case form a data set. Background formation takes place in that the signal values determined at the same scanning time within the wobble cycles used for background formation are added and subsequently the sum values obtained are divided by the number of wobble cycles used for background formation, i.e. standardization takes place to this number. The formation of said "foreground" fundamentally takes place in the same way. Background subtraction in the difference former 170 takes place separately with respect to the individual scanning times.

The data set resulting from background subtraction is finally supplied to an evaluating unit 180, where it undergoes further evaluation. The evaluating unit can be of a known type and is consequently not described in detail here. By means of the data set supplied to it, it decides regarding the presence of a resonant circuit in the area between the emitting antenna 110 and the receiving antenna 120. On a line 190 it generates an alarm signal if the presence of a resonant circuit is detected.

What is claimed is:

1. Apparatus for electronic safeguarding against burglary, the apparatus including a plurality of emitters and a plurality of receivers each defining respective emitter-receiver pairs intended to cooperate with a label equipped with a resonance circuit, the emitters each being operative to produce an electromagnetic field which excites the resonance circuit of the label if such label is located within the zone of the electromagnetic field from an associated emitter, the receivers each being operative to respond to electromagnetic signals from the label and to evaluate said signals and to trigger an alarm upon detection of a signal from the resonance label, said safeguarding apparatus comprising: a plurality of emitters each operative to emit a plurality of narrow-banded signal frequencies that fall within a broader signal frequency band, a label with a resonance circuit having at least one resonant frequency within the broader signal frequency band, a plurality of receivers each operative to receive narrow-banded frequencies corresponding with those of an associated emitter, wherein the narrow frequency band of each receiver is automatically tuned to and always corresponds with the narrow frequency band of the associated emitter of an emitter-receiver pair, and said receivers each including means for evaluating received signals for triggering an alarm signal upon detection by a receiver of a signal from a resonance label, means for individually wobbling over the broader frequency band the narrow frequency band of signals emitted by each emitter, the frequencies at which each emitter-receiver pair is wobbled being staggered relative to the frequencies of each other emitter-receiver pair by more than one period so that each receiver can receive only signals from its paired emitter.

2. The safeguarding apparatus of claim 1 wherein the emitters are operative to emit signals at various instants during one emitting interval, including means coupled to each of the emitters for switching each of the emitters on to be operative and off to be inoperative during alternating time intervals, and wherein the means for evaluating received signals is operative during the intervals between operative states of the emitters.

3. The safeguarding apparatus of claim 1, including central control station means, and wherein individual emitter-receiver pairs are synchronized by wireless transmitted signals from the central control station means.

4. The safeguarding apparatus of claim 1, wherein individual emitter-receiver pairs are synchronized by wireless transmitted signals they transmit to each other.

5. The safeguarding apparatus of claim 3, wherein the individual emitter-receiver pairs are operative to be synchronized by signals they transmit to each other via their emitters and receivers provided for resonance label recognition.

6. The safeguarding apparatus of claim 4, wherein the individual emitter-receiver pairs are operative to be synchronized by signals they transmit to each other via their emitters and receivers provided for resonance label recognition.

7. The safeguarding apparatus of claim 1 wherein the emitters are each operative to emit signals at various respective instants during one emitting period.

8. The safeguarding apparatus of claim 1 including means coupled with each of the emitters for switching each of the emitters on to be operative during a first time interval and for switching each of the emitters off to be inoperative during a second time interval that follows the first time interval, to cause the emitters to be operative during alternating time intervals.

9. The safeguarding apparatus of claim 8 wherein the receivers are operative to evaluate received signals only during time intervals between operative states of the respective emitters.

10. The safeguarding apparatus of claim 1 wherein the emitter and the receiver of each emitter-receiver pair are simultaneously operative during respective time intervals, and wherein the evaluating means of each receiver includes means for discriminating between emitter signals and resonant circuit signals and for providing an alarm signal in response to a resonant circuit signal.

11. The safeguarding apparatus of claim 10 including means for operating an emitter-receiver pair at a frequency that is a multiple of the resonant frequency of the resonance circuit to facilitate discrimination between emitter signals and resonance circuit signals.

12. The safeguarding apparatus of claim 11 wherein the ratio of emitter signal frequency to resonance circuit signal frequency is about 6.

* * * * *